United States Patent [19]

Thompson

[11] 4,080,797

[45] Mar. 28, 1978

[54] ARTIFICIAL ICE PAD FOR OPERATING IN A FRIGID ENVIRONMENT

[75] Inventor: Gene D. Thompson, Denver, Tex.

[73] Assignee: Exxon Production Research Company, Houston, Tex.

[21] Appl. No.: 709,974

[22] Filed: Jul. 30, 1976

[51] Int. Cl.[2] ..... E02D 27/00

[52] U.S. Cl. ..... 61/103; 61/1; 62/260

[58] Field of Search ..... 61/103, 50, 36 A; 62/260, 259, 235; 175/7, 8, 9, DIG. 1; 272/3

[56] References Cited

U.S. PATENT DOCUMENTS

| | | | |
|---|---|---|---|
| 3,340,928 | 9/1967 | Brown | 175/7 |
| 3,818,712 | 6/1974 | Burt et al. | 61/50 |
| 3,931,715 | 1/1976 | Fitch et al. | 61/103 |

*Primary Examiner*—Jacob Shapiro
*Attorney, Agent, or Firm*—John S. Schneider

[57] ABSTRACT

An artificial ice structure for use as a base for oilfield operations is constructed on land in a frigid environment. A containment wall encloses a predetermined area on the land to contain flood water which is allowed to freeze. The area is flooded with water until the ice structure is a desired size. A silo arrangement, which extends through the ice structure and into the underlying ground, is utilized to house well control equipment, the below ground part thereof being separable from the above ground part thereof. A core may be formed about the silo and other cores may be formed in other parts of the ice structure to provide foundations or supports for equipment installed on the ice structure.

38 Claims, 5 Drawing Figures

ARTIFICIAL ICE PAD FOR OPERATING IN A FRIGID ENVIRONMENT

BACKGROUND OF THE INVENTION

The present invention concerns an artificial ice structure or pad constructed in a frigid environment as a base for drilling, producing and related oilfield operations and, more particularly, a temporary ice pad constructed on a land site.

In areas where nearby mobile sea ice might endanger operations on the ice pad the elevation thereof can be increased to adequate heights above sea level and, if necessary, defensive measures may be adopted to prevent fast ice from riding upon or moving the ice pad. Fast ice, a continuous sheet of ice which forms in the winter in arctic regions, moves at rates of several feet per hour with a seasonal movement of as much as one hundred feet. A silo well bore protection system extends through the ice pad into the underlying ground and houses separable above and below ground well control equipment.

SUMMARY OF THE INVENTION

Briefly, the present invention includes an artificial ice pad to be used as a base for drilling, producing and related oilfield operations and a method for constructing such structure in an artic environment. The method comprises building a water retainer wall on the outer edge of a predetermined area of land and then pumping water at controlled rates and amounts to prescribed locations on the area and allowing such water to freeze. Flooding is continued until a desired elevation for the pad has been reached. An artic silo arrangement is installed within the ice pad and the underlying ground to provide housing protection for a well control assembly having above and below ground separable components. One or more cores, each of which extends through the ice pad to the underlying ground, may be employed as foundations for a drilling rig and/or other equipment.

DESCRIPTION OF THE PREFERRED EMBODIMENTS

Figure 1:
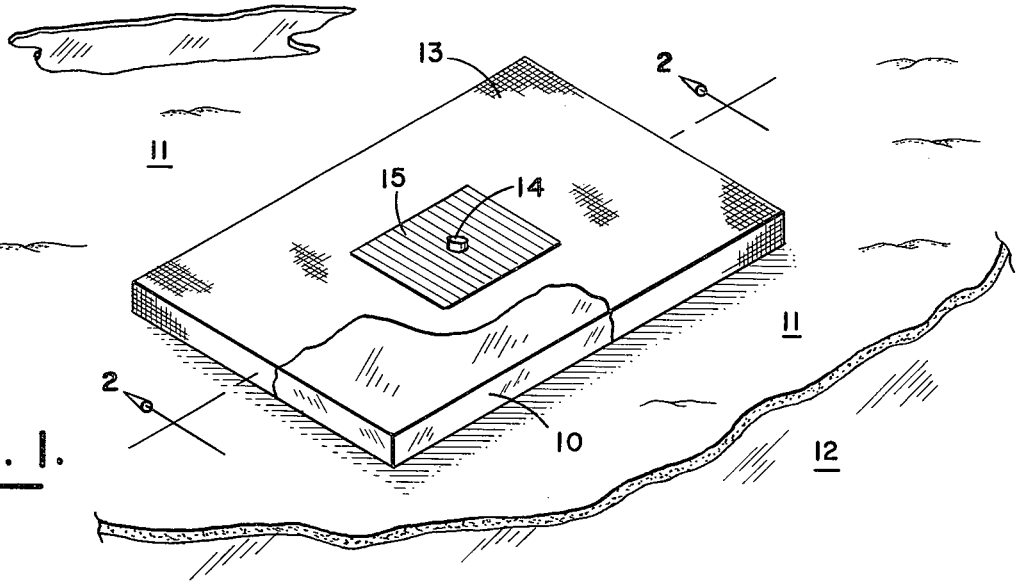
FIG. 1 is a perspective view of the ice pad in accordance with the invention.

Referring to FIG. 1 there is shown an artificial ice pad 10 constructed on land 11 adjacent a body of water 12. Land 11 may be any land site. Thus, land 11 may be an island or other land area near a body of water or it may be an inland area not near water. Ice pad 10 may be constructed in a manner similar to the manner in which the offshore ice structure is built as described in U.S. patent application Ser. No. 709,975 entitled "Offshore Structure in Frigid Environment" by Gene D. Thompson and Hans O. Jahns. In that construction an ice berm or dike is formed to surround or enclose a predetermined area by piling snow, spraying the snow with water and allowing the sprayed snow to freeze. The ice dike contains the flood water which is distributed through a water distribution system for flooding the area to form the artificial ice. Each flood layer thickness is preferably small, e.g. 4 inches, to facilitate freezing. The ice dike is built up as it is needed to confine the flood water. The water distribution system pumps water to prescribed locations on the predetermined area at rates controlled to allow maximum freezing of water for the ambient conditions and to yield ice with satisfactory strength properties for supporting the loads that a drilling rig would exhibit. Instead of using snow berms or dikes to serve as the containment walls for the flooding water wooden forms, sand or other available construction materials may be used. Ice pad 10 is built up by flooding the inside confined area surrounded by the containment walls with two to six inches of water per day and permitting the cold weather to freeze the water before adding another lift. In hostile island or shore areas where mobile sea ice might endanger operations to be conducted on the ice pad the elevation thereof may be increased to eight to ten feet above sea level. Slope protection may be employed to prevent weather and wave erosion along the sides of the embankments of ice pad 10. Also, gabions and/or sand bags may be used to protect ice pad 10 during breakup and storms. The ice pad may provide, for example, an operating area of 300 by 500 feet.

Reinforcing materials, such as sand, wood fiber, sawdust etc. may be added during the ice forming process to enhance the integrity and strength of the ice around the side and other areas where high shock loads are expected. Such material may be mixed with the water and pumped to form the reinforced ice or such material may be applied separately by spreading the material over the ice already formed and then covering it with additional water. Certain other reinforcing materials as for example, boards, ropes, reinforcing rods, fabrics, etc. would be applied separately.

A protective cover, indicated by numeral 13, may be a specially designed covering to insulate the entire artificial ice surface. Such coverings are utilized to extend the life of the exposed surfaces and may be materials such as gravel, ployurethane, matting with air gap below etc., etc. A silo 14 is indicated in the center of ice pad 10 surrounded by a rig matting 15.

Figure 2:
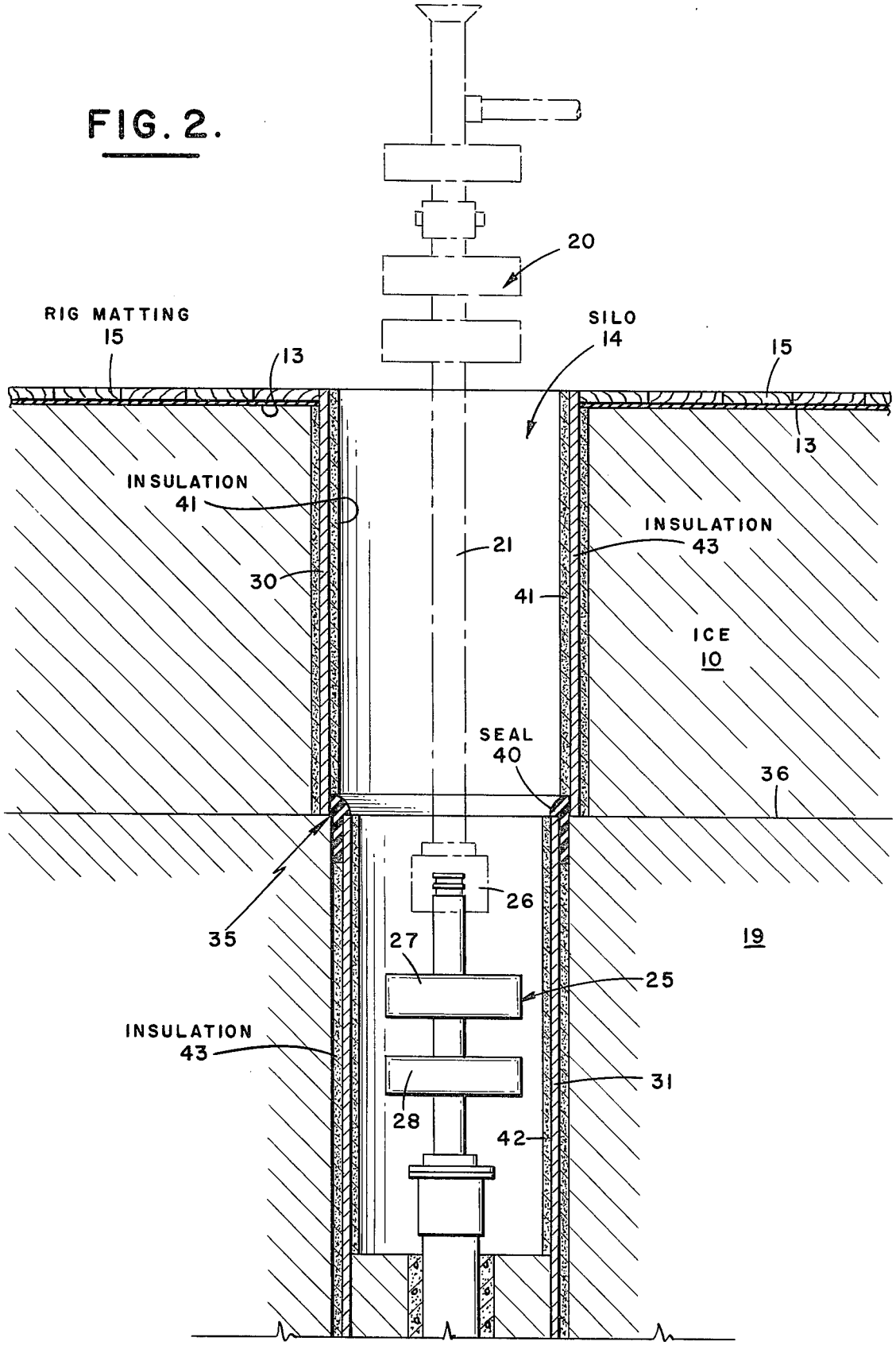
FIG. 2 is a view taken along lines 2—2 of FIG. 1.

In FIG. 2 arctic silo 14 is shown in more detail. A conventional well control blowout preventer (BOP) stack 20 is mounted on a riser pipe 21 which extends through the upper portion of silo 14 and is connected to the subground level well control assembly 25 by a connector 26 located within the lower portion of silo 14. The upper portion of silo 14 which includes prefabricated sections of a caisson 30, of e.g. 10 feet diameter, is preferably installed in ice pad 10 as it is being built. The lower portion of silo 14 includes a caisson 31 which may be driven into ground 19 to provide housing protection for subground level well control assembly 25 which, as shown, includes shear rams 27 and pipe rams 28. A weak point, indicated at 35, is formed at the ground level 36 connection between caissons 30 and 31, whether caisson 31 is made integral with or separate from caisson 30. Weak point 35 is provided so that in the event the ice pad 10 moves, only caisson 30 will be disturbed leaving subground level caisson 31 intact. In that way subground level well control assembly 35 will not be disturbed after BOP stack 20, riser pipe 21 and connector 26 are disconnected therefrom.

Figure 3:
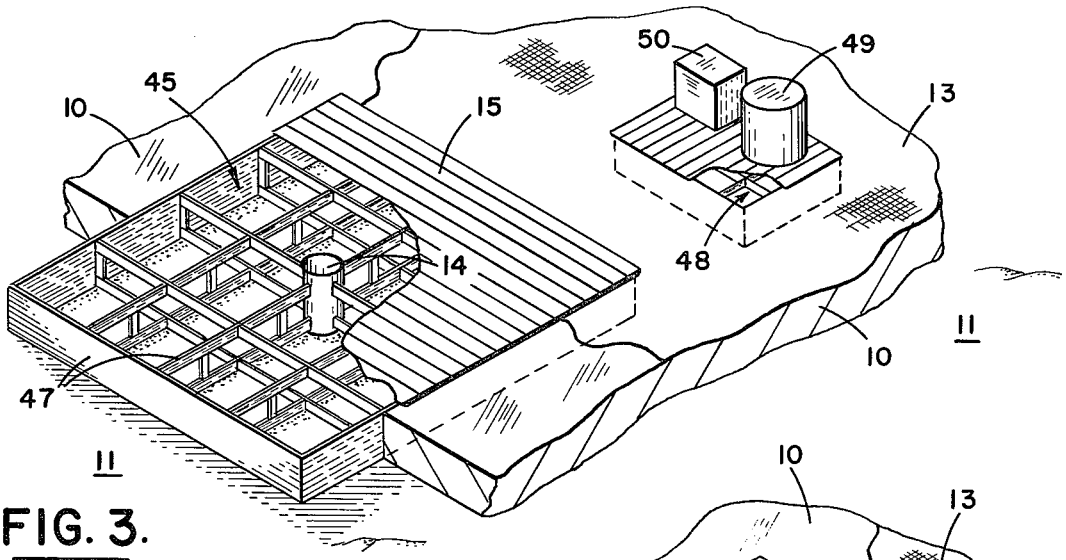
FIGS. 3 and 4 are perspective views illustrating modifications of the ice pad of FIG. 1.
Figure 5:
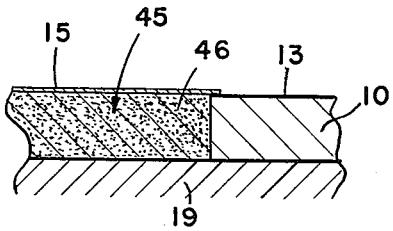
FIG. 5 is a side view illustrating still another modification of the ice pad of FIG. 1.
Figure 4:
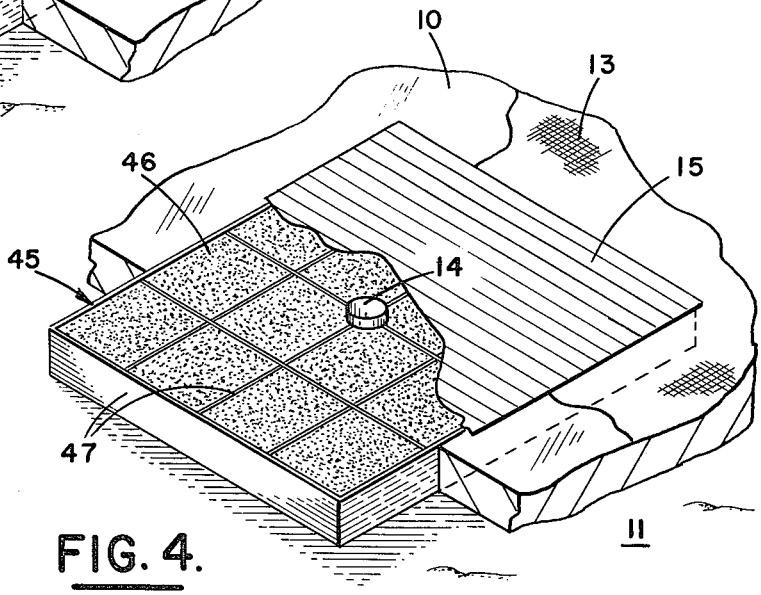

After caisson 31 is in place the inner volume thereof is evacuated hydraulically and a watertight seal 40 is installed at the subground level connection between caissons 30 and 31. The inside area of caisson 30 is then coated with insulation 41 to prevent or retard melting of the surrounding artificial ice of ice pad 10 through heat transfer. Similar insulation 42 may be provided on the inner area of caisson 31. In addition insulation, indicated by numeral 43, may be provided on the outer areas of caissons 30 and 31. The protective covering 13 on the pad's exposed surfaces is also shown in FIG. 2 along with rig matting 15 on which the rig is to be mounted. Referring to FIGS. 3, 4, and 5, a core, indicated at 45, is provided in ice pad 10 surrounding silo 14 to support a drilling rig. The core, which extends through the ice pad, may be formed of foundation material such as structural steel 47, alone as indicated in FIG. 3 or together with conventional sand and/or gravel 46 as shown in FIG. 4. The structural steel foundation may be prefabricated or may be another steel section of the drilling rig substructure. The sand and/or gravel 46 also may be used alone as shown in FIG. 5. Core 45, which may be installed around the silo before or after constructing the ice pad provides a foundation for a drilling rig which can withstand greater dynamic shock loads and, in addition, can provide an all-season base on which to leave the drilling rig during an extended period of time in the summer season.

One or more other cores 48 as shown in FIG. 3 may be formed in other parts of ice pad 10, in the same manner as core 45, to provide a foundation for other equipment or materials such as fuel tank 49, heater 50, etc. As shown in FIGS. 3, 4, and 5 core 45 may be covered by rig matting 15.

The disconnectable subground level wellhead and disconnectable caisson sections also function to permit the subground level well control assembly to remain in place in the event in the summer the ice pad melts. In that case the upper well control assembly may be disconnected from the lower well control assembly and reconnected after the ice pad is again built up in the winter. Likewise, the blowup preventers can be removed and wellheads can be installed after drilling has been completed with silo 14 continuing to protect the more permanent installation.

The ice pad may be constructed of fresh water or lake water or salt water nearby the land sites upon which the ice pad is constructed depending upon the availability of water.

Various procedures to extend and strengthen the life of the ice pad, such as those disclosed in the afore-mentioned patent application, may be employed. They include heat extraction devices installed through the ice mass and into the ground underlying the ice mass to remove heat from the ground to accelerate freezing thereof and aid in anchoring the ice pad in place. A slot or slots may be cut into any surrounding natural ice sheet adjacent the ice pad to form points of weakness such that if the fast ice sheet moves it will fail at such slots piling up on the edge of the ice pad before exerting a large enough force to cause the ice pad to move. Refrigeration tubes may be installed to aid in maintaining strength of the ice pad. Also, explosives and melting may be employed to resist movement of any adjacent ice sheet.

Other variations and changes may be made in the ice pad and method of constructing it shown and/or described herein without departing from the scope of the invention as defined in the appended claims.

Having fully described the method, apparatus, objects and advantages of my invention I claim:

1. A method for constructing an ice pad on land in an arctic environment comprising:

selecting a predetermined area of said land on which to locate said ice pad;

building a container wall to contain water adjacent the periphery of said predetermined area;

flooding said area within said container wall with water and allowing said water to freeze;

further flooding said area until an operating surface has been formed;

installing a caisson in said ice pad extending from said surface into the ground underlying the ice pad, said caisson having upper and lower parts, said upper part extending from said surface to said ground level and said lower part extending from said ground level to below said ground level.

2. A method as recited in claim 1 including sealing the area between said upper and lower caisson parts.

3. A method as recited in claim 2 in which said caisson is formed integral.

4. A method as recited in claim 3 including installing lower well control equipment below said ground level within said caisson and upper well control equipment in said caisson above said ground level releasably connected to said lower well control equipment.

5. A method as recited in claim 4 including adding reinforcing materials to said flood water to improve the integrity and strength of said ice pad.

6. A method for building a base for oilfield operations in an arctic environment comprising:

selecting a predetermined area of land at which to locate said base;

forming an ice pad extending upwardly from said land on said predetermined area;

installing a caisson entirely through said ice pad and into the ground underlying said ice pad;

said caisson having upper and lower parts, said upper part extending through said ice pad to said ground level and said lower part extending from said ground level to below said ground level.

7. A method as recited in claim 6 in which at least one core is formed through said ice pad to the underlying ground to provide a foundation for equipment on said ice pad.

8. A method as recited in claim 7 in which said core is formed around said caisson.

9. A method as recited in claim 8 in which said core is formed of construction material.

10. A method as recited in claim 7 in which said core is formed of construction material.

11. A method as recited in claim 6 including sealing the area between said upper and lower caisson parts.

12. A method as recited in claim 11 in which said caissson is formed integral.

13. A method as recited in claim 12 including installing lower well control equipment below said ground level within said caisson and upper well control equipment in said caisson above said ground level releasably connected to said lower well control equipment.

14. A method as recited in claim 13 in which said caisson is separable at said ground level.

15. A method for constructing a structure in an arctic environment comprising:

forming an artificial ice pad extending from land to thereabove; and installing a caisson entirely through said ice pad to below said ground level, said caisson having upper and lower parts, said upper part extending through said ice pad to said ground level and said lower part extending from said ground level to below said ground level.

16. A method as recited in claim 15 including sealing the area between said upper and lower caisson parts.

17. A method as recited in claim 16 in which said caisson is formed integral.

18. A method as recited in claim 17 including installing lower well control equipment below said ground level within said caisson and upper well control equipment in said caison above said ground level releasably connected to said lower well control equipment.

19. A method as recited in claim 18 in which said caisson is separable at said ground level.

20. An ice structure constructed on land in an arctic environment comprising:

an artificially formed ice pad extending upwardly from ground level, said artificial ice having a flat uppermost surface;

a caisson formed in said ice pad extending from said surface into the ground underlying said ice pad; and said caisson having an upper portion above ground and a lower portion below ground and a weak point therebetween at ground level.

21. A structure as recited in claim 20 including a watertight seal formed at said ground level between said upper and lower portions of said caisson.

22. A structure as recited in claim 21 including insulation on said caisson above and below said ground level to resist heat transfer therethrough.

23. A structure as recited in claim 22 including first well control equipment located within the lower portion of said caisson.

24. A structure as recited in claim 23 icluding second surface well control equipment releasably connected to said first well control equipment.

25. A structure in an arctic environment comprising an artificially formed ice pad extending above land; and a protective caisson formed through said ice pad extending from the surface thereof into the ground underlying the ice pad, said caisson having an upper portion above the ground level and a lower portion below the ground level and a weak point therebetween at said ground level.

26. A structure as recited in claim 25 including a watertight seal formed at said ground level between said upper and lower portions of said caisson.

27. A structure as recited in claim 26 including well control equipment located in said caisson below said ground level.

28. A structure as recited in claim 27 including well control equipment located above said ground level releasably connected within said caisson to said well control equipment located below said ground level.

29. A structure as recited in claim 28 including first well control equipment located within the lower portion of said caisson.

30. A structure as recited in claim 29 including second surface well control equipment releasably connected to said first well control equipment.

31. An arctic structure for conducting oilfield operations formed on land comprising:

an ice pad extending upwardly from said land;

a caisson extending through said ice pad into the ground underlying said ice pad; and said caisson having an upper portion above said ground and a lower portion below said ground and a weak point therebetween at ground level.

32. A structure as recited in claim 31 including a core comprising structural material extending through said ice pad surrounding said caisson to support equipment on said ice pad.

33. A structure as recited in claim 31 including a core comprising structural material extending through said ice pad to support equipment thereon.

34. A structure as recited in claim 33 in which said structural material comprises sand and/or gravel.

35. A structure as recited in claim 34 in which said structural material includes structural steel.

36. A structure as recited in claim 31 including a watertight seal formed at ground level between said upper and lower portions of said caisson.

37. A structure as recited in claim 36 including well control equipment located in said caisson below said ground level.

38. A structure as recited in claim 37 including well control equipment located above said ground level releasably connected within said caisson to said well control equipment located below said ground level.

* * * * *